US006553621B2

(12) United States Patent
Isele

(10) Patent No.: US 6,553,621 B2
(45) Date of Patent: Apr. 29, 2003

(54) HINGE

(75) Inventor: Herbert Isele, Lustenau (AT)

(73) Assignee: Julius Blum Gesellschaft m.b.H., Hochst (AT)

( * ) Notice: Subject to any disclaimer, the term of this patent is extended or adjusted under 35 U.S.C. 154(b) by 69 days.

(21) Appl. No.: 09/793,135

(22) Filed: Feb. 27, 2001

(65) Prior Publication Data

US 2001/0016967 A1 Aug. 30, 2001

(30) Foreign Application Priority Data

Feb. 28, 2000 (AT) ..... 306/00

(51) Int. Cl.[7] ..... E05D 7/04
(52) U.S. Cl. ..... 16/238; 16/240; 16/246
(58) Field of Search ..... 16/238, 239, 240, 16/245, 246, DIG. 39, 236, 237; 411/410

(56) References Cited

U.S. PATENT DOCUMENTS 3,863,292 A * 2/1975 Grunert et al.
3,938,219 A * 2/1976 Rock et al.
3,952,366 A * 4/1976 Rock et al.
3,965,530 A * 6/1976 Rock et al. ..... 16/130
3,977,041 A * 8/1976 Rock et al. ..... 16/129
4,304,028 A * 12/1981 Rock et al. ..... 16/131
4,359,802 A * 11/1982 Rock ..... 16/238
4,412,366 A * 11/1983 Rock et al. ..... 16/236
4,654,932 A * 4/1987 Rock et al. ..... 16/382
4,701,979 A * 10/1987 Salice ..... 16/346
4,797,045 A * 1/1989 Lautenschlager, Jr. et al. .. 411/107
4,882,808 A * 11/1989 Rock et al. ..... 16/240
5,056,189 A * 10/1991 Brustle et al. ..... 16/235
5,193,247 A * 3/1993 Placer et al. ..... 16/236
5,493,759 A * 2/1996 Salice ..... 16/238
5,611,113 A * 3/1997 Rock et al. ..... 16/246
6,106,185 A * 8/2000 Isele et al. ..... 403/297
6,205,617 B1 * 3/2001 Held et al. ..... 16/246

FOREIGN PATENT DOCUMENTS

AT 364619 3/1981
DE 35 41 110 A1 * 5/1987

* cited by examiner

*Primary Examiner*—Anthony Knight
*Assistant Examiner*—Alison K. Pickard
(74) *Attorney, Agent, or Firm*—Wenderoth, Lind & Ponack. L.L.P.

(57) ABSTRACT

A hinge comprising: a hinge arm; and a mounting plate by means of which said hinge arm can be mounted to a furniture side wall. The hinge arm is hingedly connected to a hinge member. An adjustment screw is provided to adjust the position of the hinge arm with respect to the mounting plate. The mounting plate has a slot open at one end and having two elongated rims opposed to each other. The adjustment screw is mounted in said hinge arm so as to be turnable but axially undisplaceable with respect to said hinge arm. The opposed rims of the slot engage in the screw thread of the adjustment screw, so that the adjustment screw can be screwed into the slot of the mounting plate.

20 Claims, 3 Drawing Sheets

HINGE

BACKGROUND OF THE INVENTION

The present invention relates to a hinge comprising a hinge arm; a mounting plate by means of which said hinge arm can be mounted to a furniture side wall; a hinge member, said hinge arm being hingedly connected to said hinge member; an adjustment screw having a screw thread to adjust the position of said hinge arm with respect to said mounting plate, said mounting plate having a slot open at one end and having two elongated rims opposed to each other.

In conventional hinges the hinge arm is secured on a base plate by means of a clamping screw. To make it possible to adjust the position of the hinge arm in the direction of the depth of the article of furniture this clamping screw protrudes through a slot in the hinge arm.

Further lateral adjustment of the hinge arm with respect to a side wall of the piece of furniture is possible. According to the prior art this lateral adjustment is achieved by an adjustment screw which is screwed into a female thread in the hinge arm and has a head which is anchored in the base plate.

With modern hinges hinge arm is mounted on an intermediate piece which is situated between the hinge arm and the base plate.

An example for such a hinge is shown in U.S. Pat. No. 4,800,622. When mounting such a hinge it is sufficient to hang the intermediate piece which is screwed to the hinge arm onto the base plate and to tilt the hinge arm with the intermediate piece towards to the side wall of the piece of furniture whereby the intermediate piece is automatically arrested on the base plate with adjustment of the position of the hinge arm with respect to the base plate is still possible. In this case the adjustment screw is screwed into a female thread in the hinge arm and is anchored with its head in the intermediate piece.

U.S. Pat. No. 4,304,028 shows a hinge with a hinge arm and a base plate whereby the hinge arm is mounted on the base plate by means of an adjustment screw which is anchored in elongated slots. The rings of the slots are staged with respect to each other thereby providing a better hold for the head of the adjustment screw.

A disadvantage of the hinges according to the prior art is that depending on the lateral displacement of the hinge arm the adjustment screw can project so far from the hinge arm that it is considered as inconvenient.

SUMMARY OF THE INVENTION

It is the object of the present invention to provide a hinge of the afore-mentioned kind whereby the adjustment screw is always flush with the hinge arm independent of the lateral position of the hinge arm with respect to the base plate.

According to the invention this is achieved in that said adjustment screw is mounted in said hinge arm so as to be turnable but axially undisplaceable with respect to said hinge arm; and the opposed rims of the slot engage in the screw thread of the adjustment screw, so that the adjustment screw can be screwed into the slot of the mounting plate.

The mounting plate can be a base plate which is directly mounted on a side wall of a piece of furniture or it can be an intermediate piece which is mounted on a base plate.

BRIEF DESCRIPTION OF THE DRAWINGS

The present invention will now be described in more detail by way of example only with reference to the accompanying drawings wherein.

The hinge 1 according to the invention is provided with a hinge arm 3 which is to be mounted on a side wall of a piece of furniture and a hinge cup 5 to be inserted into a bore in a door. The hinge cup 5 is hinged to the hinge arm 3 by means of articulated hinge links 4.

Figure 5:
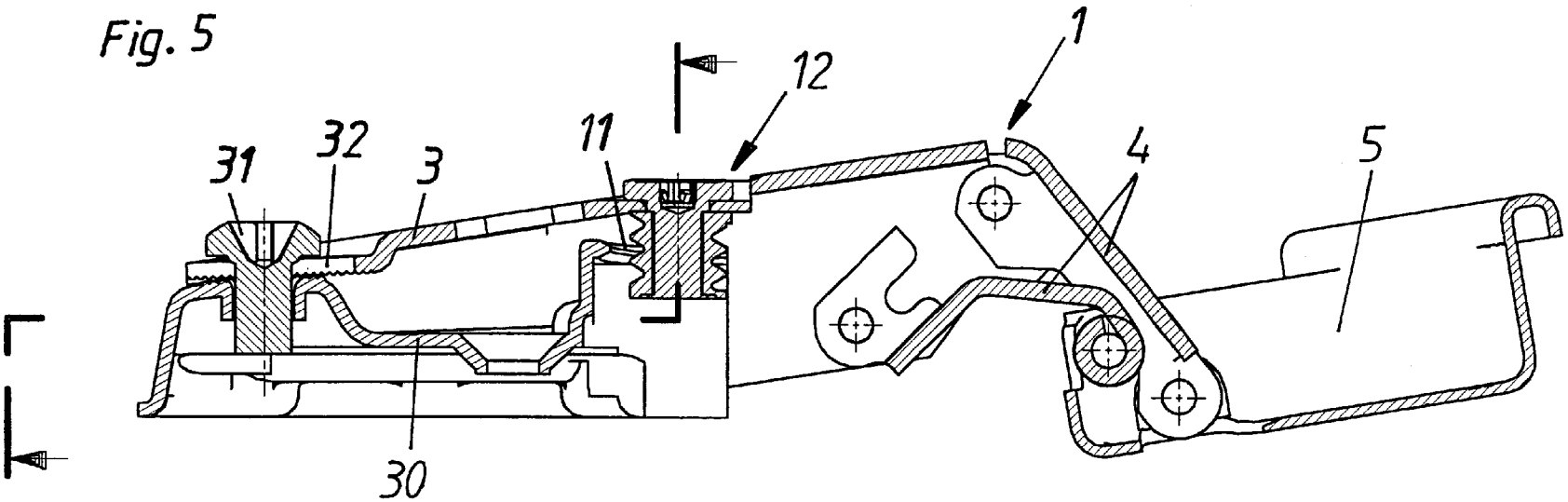
FIG. 5 is a longitudinal sectional view of a hinge according to a further embodiment of the invention.

A base plate 30 is provided which is mounted directly on the furniture side wall. In the embodiment of FIG. 5 a hinge arm 3 is mounted directly on the base plate 30 by means of the adjustment screw 12 and a clamping screw 31. The clamping screw is situated on a female thread in the base plate 30 and extends through slot 32 in the hinge arm 3 which is opened towards the rear of the hinge arm 3.

Figure 1:
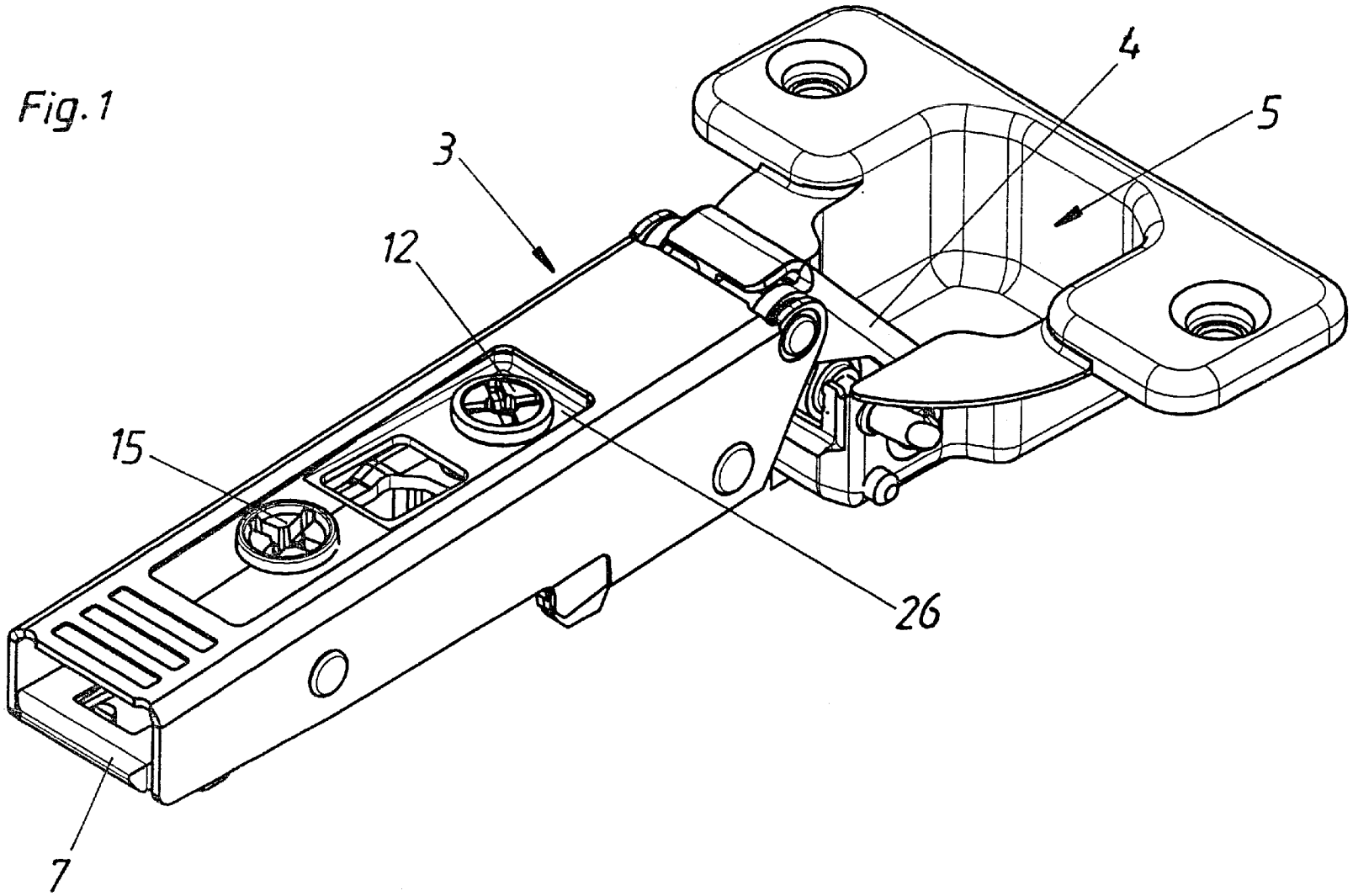
FIG. 1 is a perspective view of the hinge according to the invention.
Figure 2:
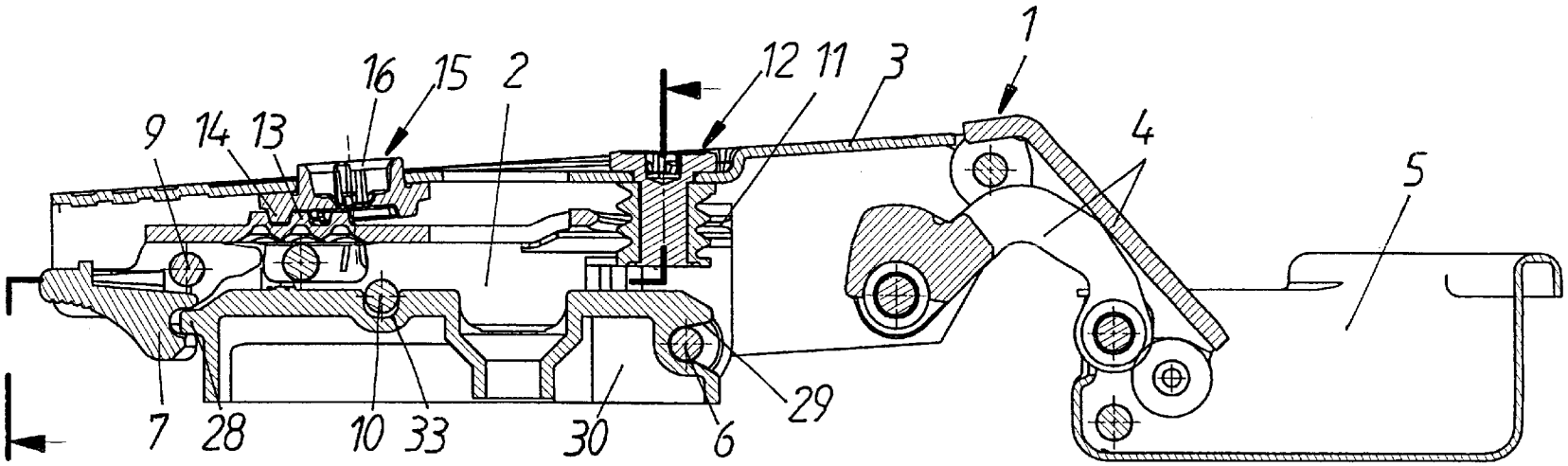
FIG. 2 is a longitudinal sectional view of a hinge according to the invention.
Figure 4:
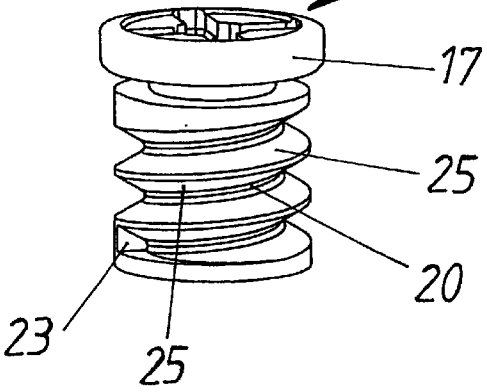
FIG. 4 is a perspective view of the adjustment screw.

In the embodiment of FIG. 2 the hinge arm 3 is mounted on the base plate 30 by means of an intermediate piece 2 which is mounted within the hinge arm 3 and which is anchorable on the base plate 30. The intermediate piece 2 has a U-cross section and embraces the base plate 30 when in the mounted position.

At its end that is directed towards the hinge axle the intermediate part is provided with a pin 6 which when the intermediate piece 2 is mounted on the base plate 30 is held in a groove or notch 29 of the base plate 30.

At its rear end the intermediate piece 2 is provided with a tilting lever 7 which is mounted on the intermediate piece 2 by means of an axle 9 and is acted upon by a spring.

When the intermediate piece 2 is mounted on a base plate 30 the tilting lever 7 engages behind holding protrusion 28 at the rear end of the base plate 30. Approximately in the middle of the intermediate piece 2 a locking bolt 10 is provided with is held in a corresponding notch 33 of the base plate 30 so that the intermediate piece 2 is held on the base plate 30 without clearance. In the U.S. Pat. No. 4,800,622 the mounting of the intermediate piece 2 on the base plate 30 is described in detail.

At its end which is directed towards the hinge axle the intermediate piece 2 is provided with an open slot 11 in which the adjustment screw 12 is held. The adjustment screw 12 is held in the intermediate piece 2 as well as in the hinge arm 3.

At the rear end of the intermediate piece 2 a series of projections 13 is provided which engage with a spiral web 14 of a disc 15. The disc 15 is provided with a cylindrical holder 16 which engages on a corresponding opening in the middle web of the hinge arm 3. By turning the disc 15 the hinge arm 3 is moved relatively to the intermediate piece 2 in the direction of the depth of the piece of furniture. Contrary to the hinges according to the prior art with which the adjustment screw is screwed into a female thread of the hinge arm and is anchored with his head in the open slot in the intermediate piece with a hinge according to the invention the adjustment screw 12 is fastened to the hinge arm 3 by means of its head 17.

Figure 3:
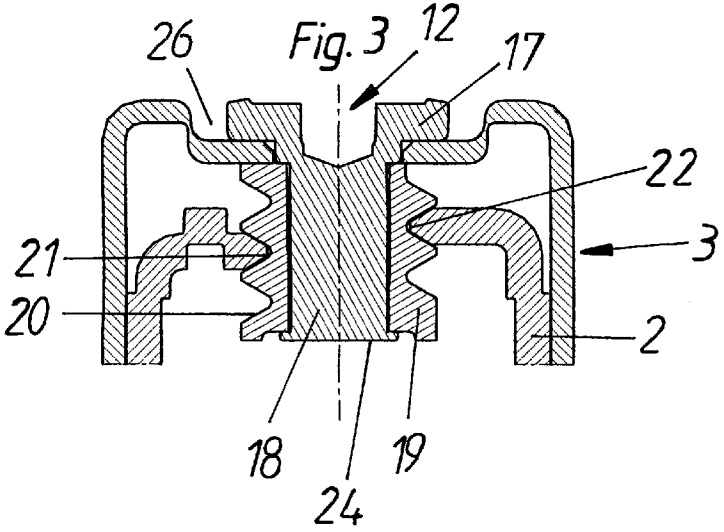
FIG. 3 is a cross sectional view through the parts of the hinge arm mounted on the furniture side wall taken in the area of the adjustment screw for lateral adjustment.

The adjustment screw 12 is made of two parts. One part is a male part 18 provided with the head 17, the second part is a female part 19 which is fastened to the male part 18. The hinge arm 3 is held between the head 17 and the female part 19 (FIGS. 2 and 3). At its far end 24 the male part 18 is riveted to the female part 19.

The opposed rims 21, 22 of the slot 11 engage in the screw thread 20 of the adjustment screw 12 (FIG. 3). Because of this arrangement the adjustment screw 12 can be screwed in and out of the slot 11 as if it were a common female thread. By turning the adjustment screw 12 the front end of the hinge arm 3 on which the hinge links 4 are mounted is either moved towards to the furniture side wall or away from the furniture side wall. If the hinge arm 3 is displaced in a direction of the depth of the piece of furniture the adjustment screw 12 can be slideably moved in the longitudinal direction of the slot 11.

The rims 21, 22 of the open slot 11 are provided with inclined flanks which correspond to the flanks 25 of the screw thread 20 of the adjustment screw 12. By this arrangement the adjustment screw 12 is held in the intermediate piece 2 without play. The hold of the adjustment screw 12 in the intermediate piece 2 is also improved by the rims 21, 22 being staggered with respect to each other.

The screw thread 20 of the adjustment screw 12 is at its far end with respect to the head 17 provided with an abutment stop 23. Because of the abutment stop 23 the adjustment screw 12 cannot be screwed out of the open slot 11 unintentionally. The head 17 of the adjustment screw 12 is situated in a recess 26 of the hinge arm 3 so that it is flush with the hinge arm 3.

What is claimed is:

1. A hinge comprising:

a hinge arm;

a mounting plate for mounting said hinge arm to a furniture piece sidewall, said hinge arm being movably connected to said mounting plate so as to be operable to slide relative to said mounting plate, said mounting plate having an elongated slot formed by a pair of opposing rims;

a hinge member hinged to said hinge arm; and an adjustment screw having a screw thread and being mounted to said hinge arm so as to be rotatable and axially non-moveable relative to said hinge arm, said screw thread of said adjustment screw being operable to engage said opposing rims of said elongated slot so that said hinge arm is moved toward and away from said mounting plate as said adjustment screw is rotated.

2. The hinge of claim 1, wherein said mounting plate comprises a base plate adapted to be directly fastened to the furniture piece sidewall.

3. The hinge of claim 1 further comprising a base plate adapted to be directly fastened to the furniture piece sidewall, said mounting plate comprising an intermediate piece mounted on said base plate.

4. The hinge of claim 1, wherein each of said opposing rims of said elongated slot has an inclined edge, an angle of said inclined edge of each of said opposing rims corresponding to an angle of said screw thread of said adjustment screw.

5. The hinge of claim 1, wherein said adjustment screw includes a male part having a head, and includes a female part having said screw thread, said adjustment screw being arranged so that said hinge arm is fixed between said head of said male part and an end of said female part.

6. The hinge of claim 5, wherein a distal end of said male part opposite said head is riveted to said female part.

7. The hinge of claim 5, wherein said hinge arm has a recess formed therein, said adjustment screw being arranged so that said head is accommodated within said recess.

8. The hinge of claim 1, wherein said adjustment screw has a head at a first end thereof, and has an abutment stop in said screw thread at a second end thereof opposite said first end.

9. The hinge of claim 1, wherein said opposing rims of said elongated slot are staggered relative to each other along a direction parallel to a longitudinal axis of said adjustment screw.

10. The hinge of claim 1, wherein said elongated slot has a first end and an open second end opposite said first end, said adjustment screw being operable to enter and withdrawal from said elongated slot via said open second end when said hinge arm is moved relative to said mounting plate along a longitudinal axis of said hinge arm.

11. A hinge comprising:

a hinge arm;

a discrete mounting plate separate from said hinge arm, and for mounting said hinge arm to a furniture piece sidewall, said mounting plate having an elongated slot formed by a pair of opposing rims, said elongated slot having a first end and an open second end opposite said first end, said hinge arm being operable to slide relative to said mounting plate to thereby engage and disengage said mounting plate;

a hinge member hinged to said hinge arm; and an adjustment screw having a screw thread and being mounted to said hinge arm so as to be rotatable and axially non-moveable relative to said hinge arm, said screw thread of said adjustment screw being operable to engage said opposing rims of said elongated slot so that said hinge arm is moved toward and away from said mounting plate as said adjustment screw is rotated.

12. The hinge of claim 11, wherein said mounting plate comprises a base plate adapted to be directly fastened to the furniture piece sidewall.

13. The hinge of claim 11, further comprising a base plate adapted to be directly fastened to the furniture piece sidewall, said mounting plate comprising an intermediate piece mounted on said base plate.

14. The hinge of claim 11, wherein each of said opposing rims of said elongated slot has an inclined edge, an angle of said inclined edge of each of said opposing rims corresponding to an angle of said screw thread of said adjustment screw.

15. The hinge of claim 11, wherein said adjustment screw includes a male part having a head, and includes a female part having said screw thread, said adjustment screw being arranged so that said hinge arm is fixed between said head of said male part and an end of said female part.

16. The hinge of claim 15, wherein a distal end of said male part opposite said head is riveted to said female part.

17. The hinge of claim 15, wherein said hinge arm has a recess formed therein, said adjustment screw being arranged so that said head is accommodated within said recess.

18. The hinge of claim 11, wherein said adjustment screw has a head at a first end thereof, and has an abutment stop in said screw thread at a second end thereof opposite said first end.

19. The hinge of claim 11, wherein said opposing rims of said elongated slot are staggered relative to each other along a direction parallel to a longitudinal axis of said adjustment screw.

20. The hinge of claim 11, wherein said adjustment screw is operable to enter and withdrawal from said elongated slot via said open second end when said hinge arm is moved relative to said mounting plate along a longitudinal axis of said hinge arm.

* * * * *